US006955115B1

(12) United States Patent
A'Hearn et al.

(10) Patent No.: US 6,955,115 B1
(45) Date of Patent: Oct. 18, 2005

(54) HYDRAULIC CIRCUIT HAVING PRESSURE EQUALIZATION DURING REGENERATION

(75) Inventors: Michael A. A'Hearn, Shorewood, IL (US); Thomas J. Hajek, Sr., Lockport, IL (US); Larry W. Lorimor, Plainfield, IL (US); Daniel T. Mather, Lockport, IL (US); Srikrishnan T. Tolappa, Aurora, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 09/464,497

(22) Filed: Dec. 15, 1999

Related U.S. Application Data

(63) Continuation-in-part of application No. 09/271,069, filed on Mar. 17, 1999, now abandoned.

(51) Int. Cl.[7] ..... F15B 11/16
(52) U.S. Cl. ..... 91/437; 91/445; 91/451
(58) Field of Search ..... 91/436, 437, 445, 91/447, 451, 439

(56) References Cited

U.S. PATENT DOCUMENTS 2,670,714 A * 3/1954 Gay et al. ..... 91/451
3,211,065 A * 10/1965 Hunger et al. ..... 91/447
3,461,780 A * 8/1969 Schmon ..... 91/451
4,024,798 A * 5/1977 Schexnayder et al. ..... 91/436
4,028,889 A * 6/1977 Budzich ..... 60/445
4,194,436 A * 3/1980 Imada ..... 91/436
4,200,118 A * 4/1980 Budzich ..... 91/436
4,204,459 A * 5/1980 Johnson ..... 91/447
4,303,003 A * 12/1981 Reip ..... 91/451
4,617,854 A * 10/1986 Kropp ..... 91/517
5,353,686 A * 10/1994 Nakamura ..... 91/464
5,752,426 A * 5/1998 Ikei et al. ..... 91/451

* cited by examiner

*Primary Examiner*—F. Daniel Lopez

(57) ABSTRACT

A fluid system is provided wherein two different fluid circuits are connected in parallel with a single source of pressurized fluid and the two fluid circuits can function together even when one of the loads is lighter than the other. This is accomplished by having the lightly loaded circuit having a directional control that when operated in one of its operative positions the flow from the rod end of the cylinder is directed through the directional control valve and combined with the supply flow being directed to the head end of the cylinder. With the other heavier loaded circuit also being actuated, the pressure of the fluid from the rod end of the fluid cylinder is equalized with the pressure of the heavier loaded circuit. Consequently, the speed of the heavier loaded circuit does not stall or slow down relative to the lightly loaded circuit. In the case of a machine having a bucket used for backdragging, the circuit needs a diverter system that provides protection from the cylinder rod of the fluid cylinder 26 from buckling during backdragging while maintaining the ability for pressure equalization when not performing a backdragging operation.

16 Claims, 4 Drawing Sheets

10
12
14
16
17
18
20
22
24
26
28
30
32
34
36
38
40
42
44
46
48
50
52
54
56
58
59
60
62
64
66
68
69
70
72
74
76
78
80
82
84
86
88
90
92
94
96
98
100
102
104
106
108
110
112
114
116
118
120
121
122
125
126
128
134
150
156
A

HYDRAULIC CIRCUIT HAVING PRESSURE EQUALIZATION DURING REGENERATION

DESCRIPTION

This application is a continuation-in-part of application Ser. No. 09/271,069 filed on Mar. 17, 1999 now abandoned.

TECHNICAL FIELD

This invention relates generally to a fluid system having at least two different fluid circuits being supplied in parallel by only one fluid source and more particularly to fluid system wherein the two parallel fluid circuits having different loads may be operated simultaneously and wherein undue back pressure can be overcome when performing predefined work functions.

BACKGROUND ART

It is well known that when operating two different fluid circuits in parallel with a common pump, the circuit having the lightest load will automatically take the pump's flow. Likewise, the circuit with the heaviest load will stall or slow to such an extent that the operation of that circuit is severally hampered. It is also desirable in many systems with a light load to recombine the flow from one end of a cylinder to the other end. However, this has proved to be difficult since it required special valving in the main control spool or added valving. Even then, the functioning of the heavy loaded circuit would either slow or stall. In attempts to overcome the stalling of the heavy loaded circuit, excessive pressures would be generated in the fluid system. Some systems would provide regeneration of exhaust fluid to the other end of the cylinder by placing a restriction in the exhaust line and forcing the fluid to recombine with the flow from the pump as the flow entered the main control valve. When operating two separate circuits in parallel, this type of recombining does not work since the circuit with the heavier load would still stall or slow because the pump's flow would go to the circuit with the lightest load.

The present invention is directed to overcoming one or more of the problems as set forth above.

DISCLOSURE OF THE INVENTION

In one aspect of the present invention, a fluid system is provided and includes a single source of pressurized supply fluid that receives fluid from a reservoir and is operable to control multiple loads. The fluid system further includes first and second fluid circuits connected in parallel to the single source of pressurized supply fluid. The first fluid circuit is connected to the single source of pressurized supply fluid and has a first directional control valve connected to a first fluid cylinder. The first fluid cylinder has head end and rod end ports. The first directional control valve has a supply inlet port connected to the single source of pressurized fluid, first and second outlet ports connected to the respective head end and rod end ports of the fluid cylinder, and an exhaust port connected to the reservoir. The first directional control valve is movable between a center position and first and second operable positions. In the center position, the supply port, the first and second outlet ports and the exhaust port are blocked from one another. In the first operable position, the supply port is in communication with the second outlet port and the first outlet port is in communication with the exhaust port. In the second operable position the supply port is in communication with the first outlet port and the second outlet port is in communication with the supply port. The second fluid circuit is connected to the single source of pressurized supply fluid in parallel with the first fluid circuit and has a second directional control valve connected to a second fluid cylinder. The second fluid cylinder also has head end and rod end ports. The second directional control valve has a supply inlet port connected to the single source of pressurized fluid, first and second outlet ports connected to the respective head end and rod end ports of the second fluid cylinder, and an exhaust port connected to the reservoir. The directional control valve is movable between a center position and first and second operable positions. In the center position the supply port is blocked from the first and second outlet ports and the head end and rod end ports are blocked from the exhaust port. In the first operable position the supply port is in communication with the second outlet port and the first outlet port is in communication with the exhaust port. In the second operable position the supply port is in communication with the first outlet port and the second outlet port is in communication with the exhaust port.

BEST MODE FOR CARRYING OUT THE INVENTION

Figure 1:
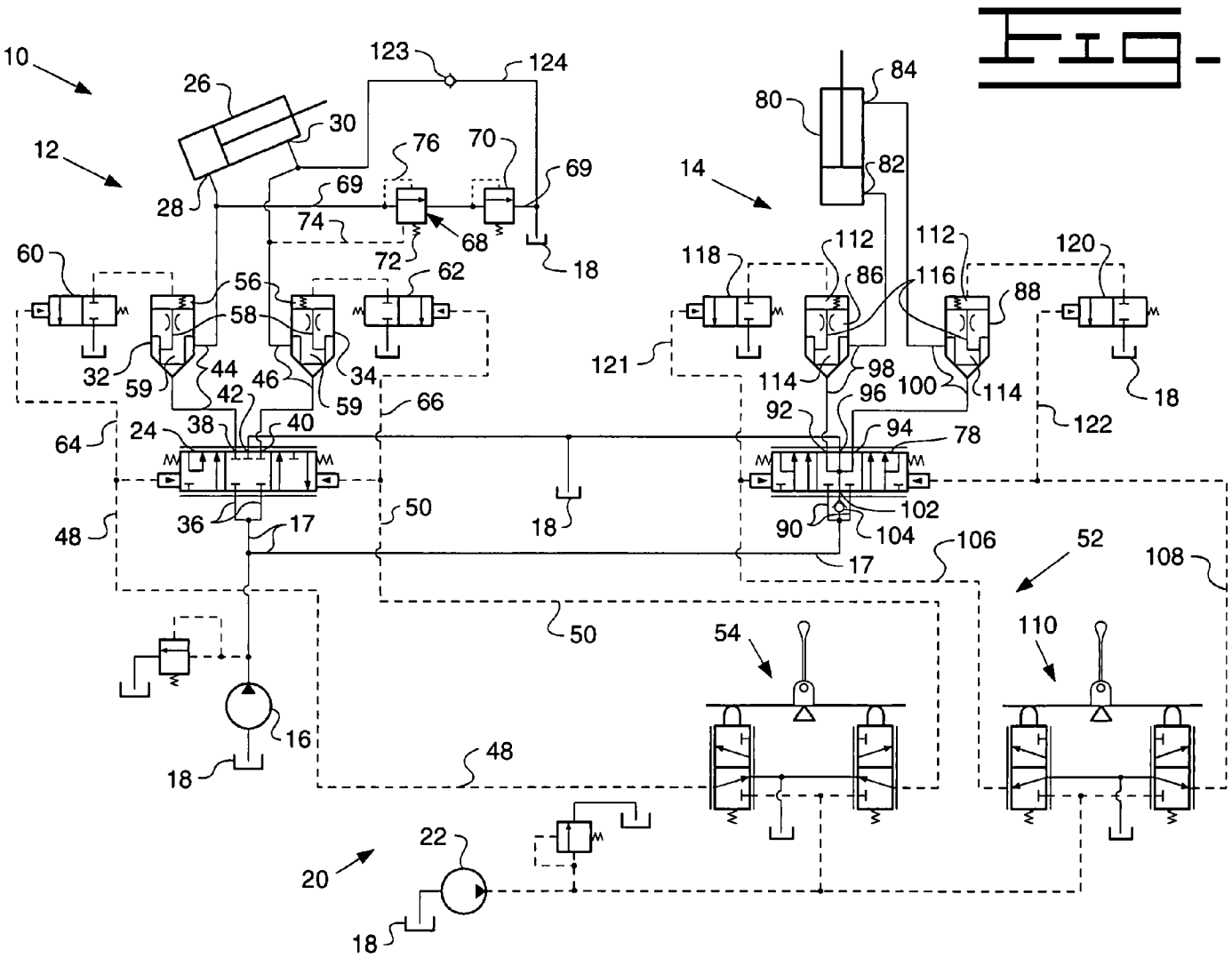
FIG. 1 is a schematic representation of a fluid system having two circuits operating in parallel with a single source of pressurized fluid and incorporating the subject invention.

Referring to FIG. 1 of the drawings, a fluid system 10 is provided and includes first and second fluid circuits 12,14 connected in parallel to a single source of pressurized supply fluid 16 via a supply conduit 17. The source of pressurized supply fluid 16 receives fluid from a reservoir 18. The fluid system 10 also includes a pilot control system 20 connected to a source of pressurized pilot fluid 22.

The first fluid circuit 12 includes a first directional control valve 24, a first fluid cylinder 26 having a head end port 28 and a rod end port 30, and first and second vented load check valves 32,34. The first directional control valve 24 has a supply port 36 connected to the supply conduit 17, first and second outlet ports 38,40 and an exhaust port 42 connected to the reservoir 18. A conduit 44 connects the first outlet port 38 to the head end port 28 of the first fluid cylinder 26 and a conduit 46 connects the second outlet port 40 to the rod end port 30 thereof.

The first directional control valve 24 is movable between a center position and first and second operable positions. In the center position, the supply port 36, the first and second outlet ports 38,40, and the exhaust port 42 are blocked from one another. In the first operable position, the supply port 36 is in communication with the second outlet port 40 and the first outlet port 38 is in communication with the exhaust port 42. In the second operable position, the supply port 36 is in communication with the first outlet port 38 and the second outlet port 40 is in communication with the supply port 36. Consequently, in the second operable position of the first directional control valve 24, the supply port is in communication with both the first and second outlet ports 38,40.

The first directional control valve 24 is biased to its center position in a conventional manner and is moved to its first and second operable positions in response to receipt of pressurized pilot fluid from the pilot control system 20 through respective first and second pilot conduits 48,50. A control input arrangement 52 is provided in the pilot control system 20 and includes a first operator controlled input arrangement 54 disposed between the source of pressurized pilot fluid 22 and the first and second pilot conduits 48,50. The first operator controlled input arrangement 54 is operative to control the position of the direction control valve 24 in response to an input by the operator.

The first vented load check valve 32 is disposed in the conduit 44 and the second vented load check valve is disposed in the conduit 46. Each of the first and second vented check valves is operative to permit flow to the first fluid cylinder and selectively block flow therefrom. Each of the first and second vented load check valves 32,34 has a pressure chamber 56 defined therein behind the valving element 59. The pressure chamber 56 of the first and second vented load check valves 32,34 is connected to the respective head end 28 and rod end 30 of the first fluid cylinder 26 through orificed conduits 58.

First and second two-position valves 60,62 are disposed between the respective pressure chambers 56 and the reservoir 18. Each of first and second two-position valves 60,62 is spring biased to a flow blocking position and movable to a flow passing position in response to receipt of pressurized fluid through respective conduits 64,66 that are respectively connected to pilot conduits 48,50.

A diverter valve 68 is disposed in a conduit 69 between head end port 28 of the first fluid cylinder 26 and the reservoir 18 and a relief valve 70 is disposed between the diverter valve 68 and the reservoir 18. The diverter valve 68 is biased to a closed position by a mechanical biasing mechanism 72 and the pressure in the rod end port 30 directed thereto through a pilot conduit 74. The diverter valve 68 is urged towards its flow passing position in response to the pressure in the head end port 28 as directed thereto through pilot conduit 76.

The second fluid circuit 14 includes a second directional control valve 78, a second fluid cylinder 80 having a head end port 82 and a rod end port 84, and third and fourth vented load check valves 86,88. The second directional control valve 78 has a supply port 90 connected to the supply conduit 17, first and second outlet ports 92,94 and an exhaust port 96 connected to the reservoir 18. A conduit 98 connects the first outlet port 92 to the head end port 82 of the second fluid cylinder 80 and a conduit 100 connects the second outlet port 94 to the rod end port 84 thereof. A fluid make-up port 102 is in continuous communication with the exhaust port 96 in all positions of the directional control valve 78 and a one-way check valve 104 provides fluid communication of the fluid in the exhaust port 96 with the supply port 90 and blocks return flow.

The second directional control valve 78 is movable between a center position and first and second operable positions. In the center position, the supply port 90 is blocked from the first and second outlet ports 92,94 and the head end port and rod end port 82,84 of the second fluid cylinder 80 are blocked from the reservoir 18. In the first operable position the supply port 90 is in communication with the second outlet port 94 and the first outlet port 92 is in communication with the exhaust port 96. In the second operable position the supply 90 is in communication with the first outlet port 92 and the second outlet port is in communication with the exhaust port 96.

The second directional control valve 78 is biased to its center position in a conventional manner and is moved to its first and second operable positions in response to receipt of pressurized pilot fluid from the pilot control system 20 through respective third and fourth pilot conduits 106,108. The control input arrangement 52 further includes a second operator controlled input arrangement 110 disposed between the source of pressurized pilot fluid 22 and the first and second pilot conduits 106,108. The second operator controlled input arrangement 110 is operative to control the position of the second direction control valve 78 in response to an input by the operator.

The third vented load check valve 86 is disposed in the conduit 98 and the fourth vented load check valve 88 is disposed in the conduit 100. Each of the third and fourth vented check valves 86,88 is operative to permit flow to the second fluid cylinder and selectively block flow therefrom. Each of the third and fourth vented load check valves 86,88 also has a pressure chamber 112 defined therein behind the valving element 114. The pressure chamber 112 of the third and fourth vented load check valves 86,88 is connected to the respective head end 82 and rod end 84 of the second fluid cylinder 80 through orificed conduits 116.

Third and fourth two-position valves 118,120 are disposed between the respective pressure chambers 112 and the reservoir 18. Each of third and fourth two-position valves 118,120 is spring biased to a flow blocking position and movable to a flow passing position in response to receipt of pressurized fluid through respective pilot conduits 121,122 that are respectively connected to pilot conduits 106,108.

A conventional make-up valve 123 is disposed in a conduit 124 connected between the rod end port 30 of the first fluid cylinder 26 and the reservoir 18.

Figure 2:
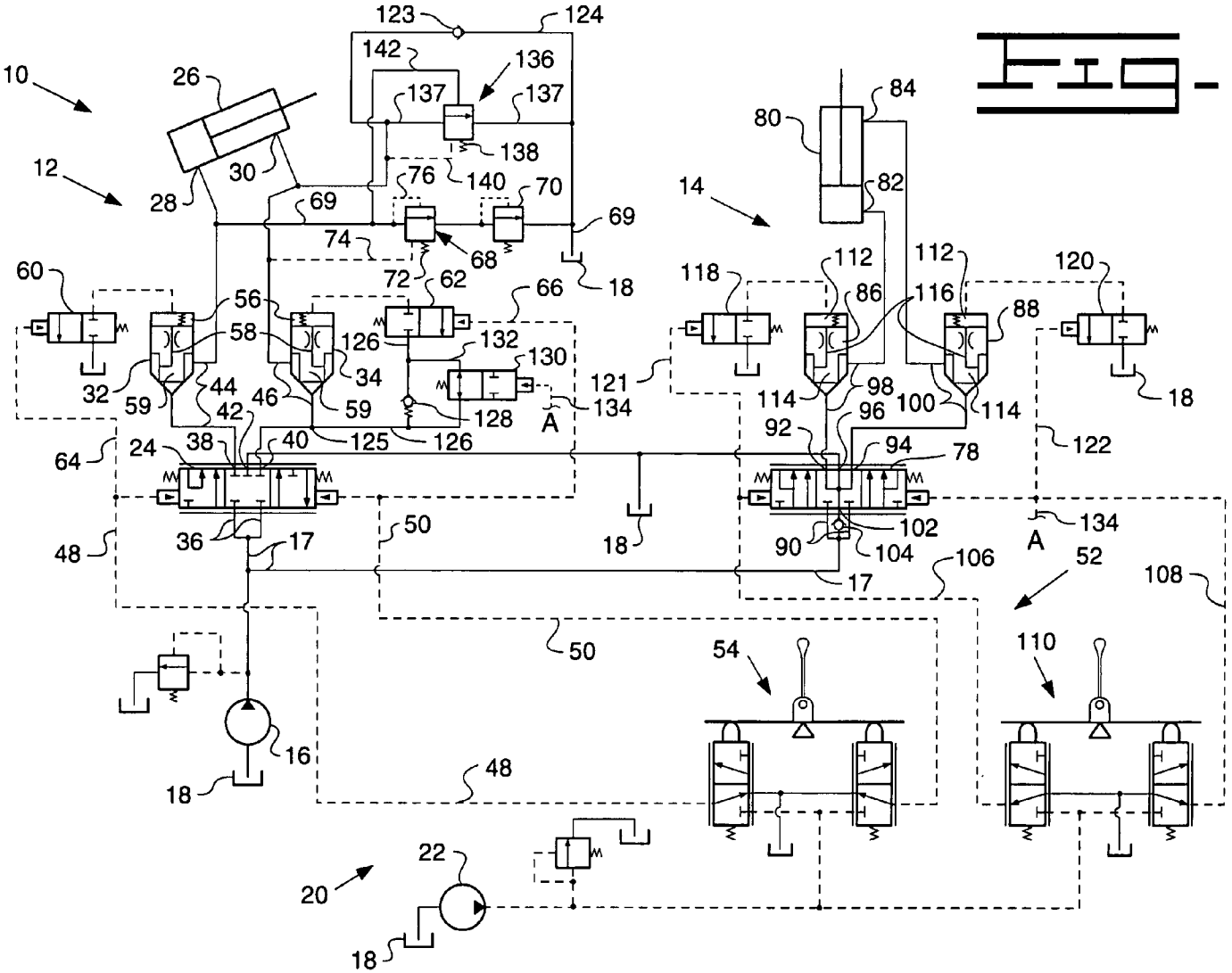
FIG. 2 is a schematic representation of the fluid system incorporating another aspect of the subject invention.

Referring to FIG. 2 another embodiment of the fluid system is disclosed. Like elements have like element numbers. In FIG. 2, the flow from the pressure chamber 56 is directed from the second two-position valve 62 to a connection point 125 between the second vented load check valve 34 and the first directional control valve 24 through a conduit 126. A one way check valve 128 is disposed in the conduit 126 and is operative to permit fluid flow from the second vented load check valve 62 to the connection point 125 and prohibit reverse flow therethrough.

A two-position bypass valve 130 is disposed in a conduit 132 and connected in parallel with the one way check valve 128 between the second vented load check valve 62 and the connection point 125. The two-position bypass valve 130 is spring biased to a flow passing position and movable to a flow blocking position in response to pressurized fluid in the fourth pilot conduit 108 connected to the second directional control valve 78 being delivered thereto through a pilot conduit 134.

A second diverter valve 136 is operatively disposed in a conduit 137 between the rod end port 30 of the first fluid cylinder 26 and the reservoir 18. The second diverter valve 136 is biased to a flow blocking position by a second mechanical biasing mechanism 138 and the pressure in the rod end 30 of the first fluid cylinder 26 directed thereto through a conduit 140 and movable towards a flow passing position in response to the pressure of the fluid in the head end 28 of the first fluid cylinder 26 directed thereto through a conduit 142.

Figure 3:
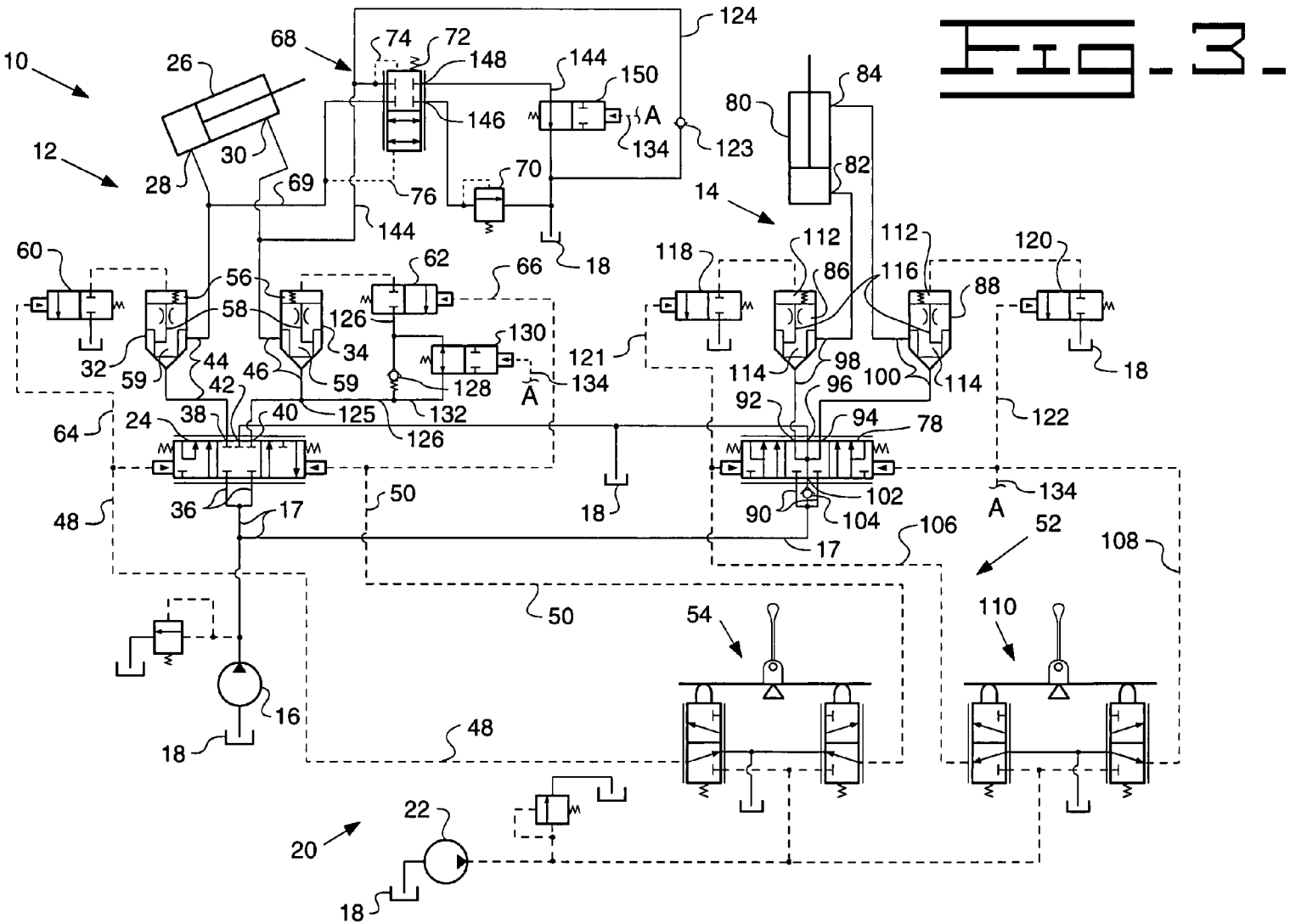
FIG. 3 is a schematic representation of the fluid system incorporating yet another aspect of the subject invention.

Referring to FIG. 3, another embodiment of the subject invention is disclosed. Like elements have like element numbers. FIG. 3 is quite similar to FIG. 2. The main differences being that the second diverter valve 136 is not required and the first diverter valve 68 has been modified. The first diverter valve 68 of FIG. 3 is a two-position four-way valve connected to the head end port 28 by the conduit 69 and to the rod end port 30 of the first fluid cylinder 26 through a conduit 144. The four-way diverter valve 68 has a head end exhaust port 146 which directs fluid from the diverter valve 68 to the reservoir 18 across the relief valve 70 and a rod end exhaust port 148 which directs fluid from the four-way diverter valve 68 to the reservoir 18 through a portion of the conduit 144. The four-way diverter valve 68 is biased to a flow blocking position by the mechanical biasing mechanism 72 and the pressure in the rod end 30 of the first fluid cylinder 26 directed thereto through the conduits 74,144 and movable towards a flow passing position by the pressure in the head end 28 of the first fluid cylinder 26 directed thereto through the conduits 76,69.

A two-position blocker valve 150 is disposed in the conduit 144 between the four-way diverter valve 68 and the reservoir 18. The two-position blocker valve 150 is spring biased to a flow passing position and movable to a flow blocking position in response to pressurized fluid in the fourth pilot conduit 108 connected to the second directional control valve 78 being directed thereto through the pilot conduit 134. The flow blocking position of the two-position blocker valve 150 blocks flow from the diverter valve 68 to the reservoir 18 but permits makeup flow from the reservoir 18 to the rod end 30 of the first fluid cylinder 26.

Figure 4:
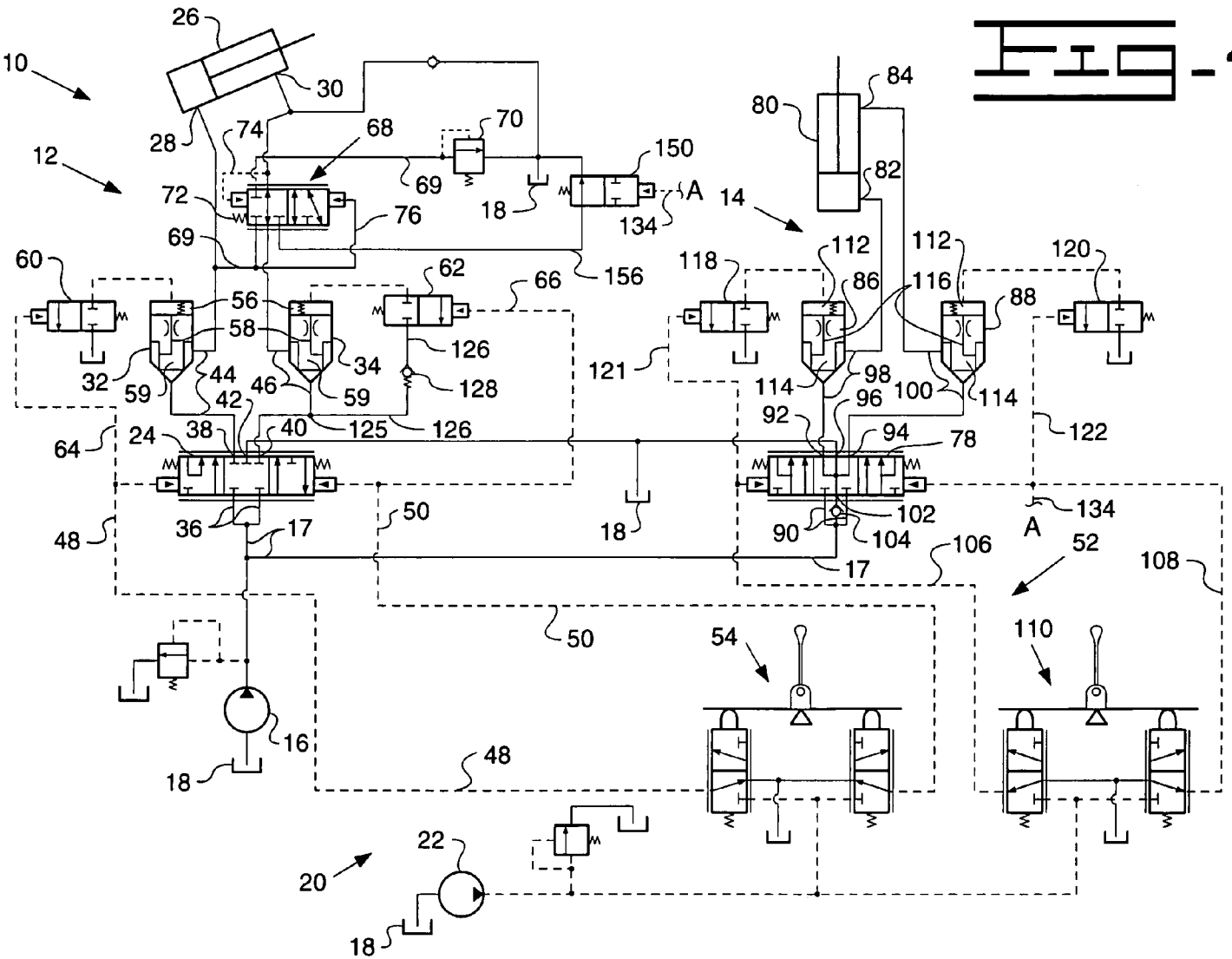
FIG. 4 is a schematic representation of the fluid system incorporating still another aspect of the subject invention.

Referring to FIG. 4 another embodiment of the subject invention is disclosed. Like elements have like element numbers. FIG. 4 is similar to FIG. 2 except the two-position bypass valve 130 and the second diverter valve 136 are not needed. Additionally, the first diverter valve 68 is a five-way, two-position valve and is operatively disposed in the conduit 46 between the rod end port 30 of the first fluid cylinder 26 and the second vented load check valve 34 and operatively connected to the head end port 28 of the first fluid cylinder 26 through the conduit 69. The five-way diverter valve 68 is biased to a first position by the mechanical biasing mechanism 72 and the pressure in the rod end 30 of the first fluid cylinder 26 as directed thereto through the conduit 74 and movable towards a second position in response to the pressure of the fluid in the head end 28 of the first fluid cylinder 26. At the first position of the five-way diverter valve 68, fluid is free to flow between the rod end port 30 and the second vented load check valve 34 and flow thereacross through the conduit 69 from the head end port 28 across the relief valve 70 to the reservoir 18 and a connection between the rod end port 30 and the reservoir 18 through a conduit 156 are blocked. At the second position of the five-position diverter valve 68, flow from the second vented load check valve to the rod end port 30 is blocked, flow through the conduit 69 is open, and flow between the rod end port 30 and the conduit 156 is open.

The two-position blocker valve 150 is disposed in the conduit 156. As previously described with respect to FIG. 3, the two-position blocker valve 150 is spring biased to a flow passing position and movable to a blocking position in response to pressure of the fluid in the fourth pilot conduit connected to the second directional control valve as directed thereto through the conduit 134. In the blocking position, flow from the two-position, five-way diverter valve to the reservoir 18 is blocked but flow from the reservoir 18 to the two-position, five-way diverter valve is permitted.

It is recognized that various components and/or arrangement could be used in the subject fluid system 10 without departing from the essence of the subject invention. For example, the control input arrangement 52 could be an electro-hydraulic control. Likewise, the first, second, third, and fourth two-position valves 60,62,118,120 could be controlled electronically. In the second fluid circuit 14, the two vented load check valves 86,88 could be eliminated and the first and second outlet ports 92,94 would be blocked from the exhaust port 96 instead of being in communication as shown in the drawing. Likewise, even though the single source of pressurized supply fluid 16 is illustrated as a fixed displacement pump, it is recognized that it could be a variable displacement pump and also could be controlled by a load sensing arrangement (not shown). Additionally, the line connecting the respective first, second, third, and fourth two-position valves 60,62,118,120 to the reservoir 18 could alternatively be connected to the line downstream of the respective first, second, third, and fourth vented load check valves 32,34,86,88. That is between the respective load check valves and the directional control valves. It may also be necessary in some instances to connect a check valve in one or more of the lines to inhibit back flow towards the two-position valve. Even though conventional make-up valves are only shown between the rod end port 30 of the first fluid cylinder 26 and the reservoir 18, it is recognized that conventional make-up valves could be provided between the head and/or rod end ports 28,30,82,84 of each of the first and second cylinders 26,80 and the reservoir 18 to ensure that each of the head and rod ends remain full of fluid at all times.

INDUSTRIAL APPLICABILITY

In the operation of the subject fluid system 10 of FIG. 1, for example, the first fluid circuit 12 normally has a lighter load than the second fluid circuit 14. This is typical in machines, such as loaders, wherein the first fluid circuit 12 is a circuit for dumping a bucket and the second fluid circuit 14 is a circuit for lifting the bucket.

If the operator desires to lift the bucket, he makes the desired input through the second operator controlled input arrangement 110. A pilot signal is directed through the pilot conduit 108 to move the directional control valve 78 towards its second operable position. This permits the pressurized flow in the supply conduit 90 from the pump 16 to pass therethrough to the head end 82 of the second cylinder 80 to extend the second fluid cylinder thus raising the bucket. The pressurized fluid acting on the valving element 114 of the third vented load check valve 86 moves it to a flow passing position in a conventional manner.

The exhaust flow from the rod end 84 returns to the reservoir 18 through the conduit 100, across the fourth vented load check valve 88 and through the second outlet port 94 and the exhaust port 96 of the directional control valve 78. Since the pilot signal in the pilot conduit 108 is also directed to the fourth two-position valve 120 moving it to its flow passing position, the pressure chamber 112 of the fourth vented load check valve 88 is open to the reservoir 18 thus permitting the valving element 114 to lift up in a conventional manner to pass flow therethrough.

If it is desired to lower the load, i.e. retract the second fluid cylinder, the operator makes an input to the second operator controlled input arrangement 110 to direct pilot pressure through the pilot conduit 106 to move the directional control valve 78 towards its first operable position. In the first operable position, the supply conduit 17 is in communication with the rod end 84 through the supply port 90 and second outlet port 94, the conduit 110, and across the second vented load check valve 88. The valving element 114 of the fourth vented load check valve 88 moves to an open position in response to the pressurized fluid to permit fluid to flow to the rod end 84.

The exhaust flow from the head end 82 returns to the reservoir 18 through the conduit 98, across the third vented load check valve 86 and through the first outlet port 92 and the exhaust port 96 of the directional control valve 78. Since the pilot signal in the pilot conduit 106 is also directed to the third two-position valve 118 moving it to its flow passing position, the pressure chamber 112 of the third vented load check valve 86 is open to the reservoir 18 thus permitting the valving element 114 to lift up in a conventional manner to pass flow therethrough.

When it is desired to retract the first fluid cylinder 26, or rack the bucket back, the operator makes an input to the first operator controlled input arrangement 54 to direct pressurized pilot fluid into the pilot conduit 48 thus moving the first directional control valve 24 towards its first operable position. In the first operable position, the supply conduit 17 is connected to the rod end port 30 of the first fluid cylinder 26 through the supply port 36 and second outlet port 40 of the first directional control valve 24, the conduit 46, and across the second vented load check valve 34. As previously noted, the valving element 59 is urged open by the pressurized fluid being directed to the rod end 30.

The exhaust flow from the head end port 28 is communicated to the reservoir 18 through the conduit 44, across the first vented load check valve 32, and the first outlet port 38 and exhaust port 42 of the first directional control valve 24. As previously noted with respect to the other vented load check valves, the valving element 59 of the first vented load check valve 32 is moved to an open position by the first two-position valve 60 being moved to its flow passing position to vent the pressure chamber 56 thereof. The first two-position valve 60 is moved to its flow passing position in response to the pressurized pilot fluid in the conduit 48 that is being directed to the first directional control valve 24.

In order to extend the first fluid cylinder 26, or dump the bucket, the operator makes an input to the first operator controlled input arrangement 54 to direct pressurized pilot fluid to the pilot conduit 50 thus moving the directional control valve 24 towards its second operable position. In the second operable position, the supply conduit 17 is connected to the head end port 28 through the supply port 36 and the first outlet port 38 of the directional control valve 24, the conduit 44, and across the first vented load check valve 32.

The exhaust flow from the rod end port 30 is directed to the second outlet port 40 of the first directional control valve 24 through the conduit 46 across the second vented load check valve 34. The valving element 59 of the second vented load check valve 34 is moved to an open position in response to the second two-position valve 62 being moved to it open position by the pressure in the pilot conduit 50. The flow at the second outlet port 40 from the rod end port 30 is directed across the first directional control valve 24 and combined with the fluid in the supply port 36. Consequently, the pressure of the fluid at both the head end port 28 and the rod end port 30 are substantially the same. The first fluid cylinder 26 extends due to the difference in area between the head end of the fluid cylinder 26 and the rod end thereof. Since the forces needed to dump a bucket is normally not large, the forces created by the area differential is sufficient to extend the cylinder or move the bucket to a dump position.

In the event the operator elects to raise the bucket by extending the second fluid cylinder 80 and simultaneously dump the load by extending the first fluid cylinder 26, the second fluid cylinder 80 will not be substantially slowed or stalled since the pump's flow will not automatically go to the lighter load (dumping of the bucket). This is true because the lightly loaded cylinder (first fluid cylinder 26) is being subjected to substantially the same level of pressure that is being generated by the heavier loaded second fluid cylinder 80. Consequently, each of the first and second cylinders 26,80 will move at the rate established by the operator inputs.

The operation of the embodiment of FIG. 2 is substantially the same as that of FIG. 1 when simultaneously extending (lifting) the second fluid cylinder 80 and extending (dumping) the first fluid cylinder 26. One difference is that the flow being exhausted from the pressure chamber 56 of the second vented load check valve 34 through the second two-position valve 62 is connected to the conduit 46 at the connection point 125 and has the one-way check valve disposed therein. The one-way check valve 128 functions to block any pressurized fluid in the conduit 46 at the connection point 125 from reverse flowing into the pressure chamber 56 of the second vented load check valve 34.

The two-position bypass valve 130 functions to permit free flow around the one-way check valve 128 whenever the second fluid cylinder 80 is not being extended (lifting the load). When the first fluid cylinder is being extended, the exhaust flow from the rod end port 30 acts on the valving element 59 of the second vented load check valve 34 to open it letting flow pass therethrough and across the first directional control valve 24 to recombine with the pump flow in supply port 36. Pressurized fluid in the pressure chamber 56 thereof is directed across the two-position valve 62, the two-position bypass valve 130 and to the connection point 125 and across the first directional control valve 24 to the supply port 36.

When it is desirable to lift the load at the same time the load is being dumped, regenerative flow with pressure equalization, the two-position bypass valve 130 is moved to the blocking position so that the pressurized fluid in the conduit 46 between the first directional control valve and the second vented load check valve 34 is prohibited from reaching the pressure chamber 56 thereof. Consequently, the valving element 59 of the second vented load check valve 34 can open to permit the pressure from the pump 16 to also pressurize the rod end port 30 at the same time it pressurizes the head end port 28. Consequently, with pressure equalization of both ends of the first fluid cylinder (dump) with respect to the pressure at the head end port 82 (lift) of the second fluid cylinder 80, the speed of lifting is not slowed or hampered by the simultaneous dumping of the load.

In many applications, it is desirable to perform an operation called "backdragging". This operation exerts a force on the rod of the cylinder urging it in a direction towards the head end of the cylinder. In the subject arrangement, the first fluid cylinder 26 is used to urge the bucket towards a position (extend the cylinder) to perform the backdragging operation. During backdragging with no lift, the pressure in the head end of the first fluid cylinder 26 is high due to the forces being exerted on the rod. If the pressure in the head end becomes too great the first diverter valve 68 opens to relieve the over pressure condition. In the event it is desirable to dump (extend the first fluid cylinder) while backdragging with no lift, the pump pressure is prohibited from reaching the rod end port 30. Consequently, the second diverter valve 136 can open with a lower head end pressure to exhaust the flow from the rod end to the reservoir 18. The pump pressure is blocked from the rod end port 30 since the pump pressure in conduit 46 is permitted to by pass the one-way check valve 128 through the two-position bypass valve 130 across the open two-position vent valve 62 and into the pressure chamber 56 of the second vented load check valve 34. With the pump pressure in the pressure chamber 56 acting on the larger area of the valving element 59, the same pump pressure acting on the opposed smaller area will not permit the valving element 59 to open.

When it is desirable to dump the load while lifting, the two-position bypass valve 130 is moved to its blocking position thus the pump pressure cannot get to the pressure chamber 56. The flow being exhausted from the rod end port 30 acts on the shoulder of the valving element 59 to open it thus permitting the rod end port 30 to achieve the same pressure as the pump pressure.

In the event that the first fluid cylinder is fully extended during simultaneous lifting and dumping, and the mechanism connected to the first fluid cylinder exerts an undue force on the rod which increases the pressure in the head end, the first diverter valve can open to relieve the over pressure condition. Since the force of the second mechanical biasing mechanism 138 is larger than the force of the first mechanical biasing mechanism 72, the second diverter valve 136 remains closed.

This arrangement would also prevent the first fluid cylinder 26 from slightly retracting when moving to the dump position with the first fluid cylinder 26 at or near the fully extended position. This slight retraction happens because the volume of fluid in the rod end is significantly less than the volume in the head end and when the first directional control valve 24 is shifted into its dump (extend) mode, without the use of the bypass valve 130, both the head and rod ends are open to the pump pressure. Due to the very low volume of fluid in the rod end, the pressure therein increases more rapidly and results in a slight retraction until the pressure in the head end equalizes therewith. Since the bypass valve 130 is in its open position, the pump pressure is allowed to flow thereacross and into the pressure chamber 56 of the second vented load check valve 34 thus holding the valving element 59 closed so that the pump pressure cannot get to the rod end port 30 thereof. The pressure in the head end port 28 quickly increases which results in a rapid increase in the pressure at the rod end port 30. Since the exhaust flow from the rod end port 30 is blocked by the valving element 59 of the second vented load check valve, the pressure increases to a level greater than the pressure in the head end port 28. Once the pressure in the rod end port 30 is larger than the pressure in the pump 16/head end port 28, the valving element 59 will open to allow the flow to exit thereacross.

The operation of FIG. 3 is the same with respect to the operation of the one-way check valve 128 and the bypass valve 130. In the embodiment of FIG. 3, the four-way diverter valve 68 functions in a similar manner to the first and second diverter valves 68,136 of FIG. 2. During a dump operation while backdragging with no lift, the four-way diverter valve 68 is used to drain the rod end to the reservoir 18. Since backdragging induces a force on the rod, the pressure in the head end 28 acts to move the diverter valve 68 to its flow passing position. At the same time the head end pressure is available to the relief valve 70 to limit pressure therein. Like the arrangement set forth in FIG. 2, this arrangement would also function in the same manner to prevent the first fluid cylinder 26 from slightly retracting when moving to the dump position with the first fluid cylinder 26 at or near the fully extended position.

Additionally, when lifting with the first fluid cylinder 26 at its fully extended position and fluid from the pump 16 is being exhausted across the diverter valve 68 and the relief valve 70, the exhausted fluid is permitted to pass across the two-position blocker valve 150 back through the four-way diverter valve 68 to fill the rod end of the first fluid cylinder.

The operation of FIG. 4 is basically the same as the operation of FIG. 2 with respect to the one-way check valve 128. However, the bypass valve 130 is not needed in this embodiment to dump while backdragging but it would still be needed if there is a desire to prevent the slight retraction of the fluid cylinder 26 before dumping with the fluid cylinder 26 at or near the fully extended position as set forth with respect to FIGS. 1 & 2 above. The five-way diverter valve 68 functions similar to that of FIG. 2. When dumping (extending the first fluid cylinder), the system operates in the same manner as that of FIG. 2. When backdragging with no lift, the head end port 28 is in communication with the relief valve 70 through the five-way diverter valve 68 and the rod end flow is directed to across the five-way diverter valve 68 and the two-position blocker valve 150 to the reservoir 18.

When dumping the load with the first fluid cylinder 26 and lifting the load with the second fluid cylinder 80, the exhaust flow from the rod end port 30 of the first fluid cylinder 26 to the reservoir across the five-way diverter valve 68 is blocked by the two-way blocker valve 150. Since the one way check valve 128 blocks the pump pressure from the pressure chamber 56 of the second vented load check valve 34, the pressure of the fluid in the rod end port 30 increases and in combination with the force of the mechanical biasing mechanism 72 urges the five-way diverter valve 68 back to its spring biased position. The increased pressure in the rod end port 30 acts on the shoulder of the valving element 59 to open it and let the flow exhaust thereacross while maintaining equal pressure on both sides of the first fluid cylinder 26.

In view of the foregoing, it is readily apparent that the subject fluid system 10 is a simple and reliable arrangement that ensures that two different circuits 12,14 may be operated in parallel without one or the other of the fluid cylinders 26,28 substantially slowing or stalling. This remains true even if the one of the cylinders is lightly loaded. The subject invention further permits one of the circuits to be used to perform a "backdragging" operation while still permitting pressure equalization between the circuits.

Other aspects, objects and advantages of the invention can be obtained from a study of the drawings, the disclosure and the appended claims.

What is claimed is:

1. A fluid system having a single source of pressurized supply fluid that receives fluid from a reservoir and being operable to control multiple loads, the fluid system comprising:

a first fluid circuit connected to the single source of pressurized supply fluid and having a first directional control valve connected to a first fluid cylinder having head end and rod end ports, the first directional control valve is a single three-position valve having a supply inlet port connected to the single source of pressurized fluid, first and second outlet ports connected to the respective head end and rod end ports of the first fluid cylinder, and an exhaust port connected to the reservoir; the single three-position valve being movable only between a center position and first and second operable positions; in the center position, the supply port, the first and second outlet ports and the exhaust port are blocked from one another; in the first operable position, the supply port is in communication through the single three-position valve with the second outlet port and the first outlet port is in communication with the exhaust port; and in the second operable position the supply port is in full communication through the single three-position valve with the first outlet port and the second outlet port is in full communication through the single three-position valve with the supply port;

a second fluid circuit connected to the single source of pressurized supply fluid in parallel with the first fluid circuit and having a second directional control valve connected to a second fluid cylinder having head end and rod end ports, the second directional control valve having a supply inlet port connected to the single source of pressurized fluid, first and second outlet ports connected to respective head end and rod end ports of the second fluid cylinder, and an exhaust port connected to the reservoir; the second directional control valve being movable between a center position and first and second operable positions; in the center position the supply port is blocked from the first and second outlet ports; in the first operable position the supply port is in communication with the second outlet port and the first outlet port is in communication with the exhaust port; and in the second operable position the supply port is in communication with the first outlet port and the second outlet port is in communication with the exhaust port; and wherein the second outlet port of the first directional control valve is in communication with the supply port thereof and with both the first outlet port thereof and with a selected one of the first and second outlet ports of the second directional control valve such that pressure equalization is always established between both ends of the first fluid cylinder and the selected one of the first and second outlet ports of the second directional control valve in response to the single three-position valve being moved from its center position towards its second operative position and the second directional control valve being moved from its center position towards one of its operative positions.

2. The fluid system of claim 1 including a diverter valve operatively connected between the head end port of the first fluid cylinder and the reservoir, the diverter valve being biased to a flow blocking position by a mechanical biasing mechanism and the pressure in the rod end of the first fluid cylinder and movable towards a flow passing position in response to pressurized fluid in the head end port of the first fluid cylinder.

3. The fluid system of claim 2, including a relief valve disposed between the diverter valve and the reservoir.

4. The fluid system of claim 1 including a first vented load check valve disposed between the first outlet port of the first directional control valve and the head end port of the first fluid cylinder and a second vented load check valve disposed between the second outlet port of the first directional control valve and the rod end port of the first fluid cylinder.

5. The fluid system of claim 4 including a pilot control system having a source of pressurized pilot fluid and a control input arrangement connected to the source of pressurized pilot fluid, the first and second directional control valves being movable from their respective center positions in response to receipt of pressurized pilot fluid being directed thereto from the control input arrangement through respective first, second, third and fourth pilot conduits.

6. The fluid system of claim 5 wherein the first and second vented load check valves each have pressure chambers that are in communication with the respective head and rod end ports of the first fluid cylinder through orificed conduits and the pilot control system includes respective first and second two-position valves spring biased to a closed position and each disposed between the respective pressure chambers and the reservoir, the first two-position valve being movable to a flow passing position in response to pressurized pilot fluid being directed to one end of the first directional control valve, and the second two-position valve being movable to its flow passing position in response to pressurized pilot fluid being directed to the other end of the first directional control valve.

7. The fluid system of claim 6 including a third vented load check valve disposed between the first outlet port of the second directional control valve and the head end port of the second fluid cylinder and a fourth vented load check valve disposed between the second outlet port of the second directional control and the rod end port of the second fluid cylinder.

8. The fluid system of claim 7 wherein the third and fourth vented load check valves each have pressure chambers that are in communication with the respective head and rod end ports of the second fluid cylinder through orificed conduits and the pilot control system includes respective third and fourth two-position valves spring biased to a closed position and each disposed between the respective pressure chambers and the reservoir, the third two-position valve being movable to a flow passing position in response to pressurized pilot fluid being directed to one end of the second directional control valve, and the fourth two-position valve being movable to its flow passing position in response to pressurized pilot fluid being directed to the other end of the second directional control valve.

9. The fluid system of claim 6 wherein the flow from the pressure chamber of the second vented load check valve through the second two-position valve is directed to the reservoir through a connection between the second vented load check valve and the first directional control valve and the fluid system also includes a one way check valve disposed between the connection and the second two-position valve, the one-way check valve permits flow from the two-position towards the connection and prohibits reverse flow.

10. The fluid system of claim 9 including a two position bypass valve disposed in parallel with the one-way check valve between the second two-position valve and the connection between the second vented load check valve and the first directional control valve, the two position bypass valve being biased towards a flow passing position and movable to a flow blocking position in response to a pilot signal being directed to the second directional control valve through the fourth pilot conduit.

11. The fluid system of claim 10 including a diverter valve operatively connected between the head end port of the first fluid cylinder and the reservoir and a relief valve disposed between the diverter valve and the reservoir, the diverter valve being biased to a flow blocking position by a mechanical biasing mechanism and the pressure in the rod end port of the first fluid cylinder and movable towards a flow passing position in response to pressurized fluid in the head end port of the first fluid cylinder.

12. The fluid system of claim 11 including a second diverter valve operatively connected between the rod end port of the first fluid cylinder and the reservoir, the second diverter valve being biased to a flow blocking position by a second mechanical biasing mechanism having a biasing force greater than the mechanism biasing force of the first diverter valve and the pressure in the rod end port of the first fluid cylinder and movable towards a flow passing position in response to pressurized fluid in the head end port of the first fluid cylinder.

13. The fluid system of claim 10 including a diverter valve operatively connected between the head end port and the rod end port respectively of the first fluid cylinder and the reservoir through respective diverter valve head end and rod end exhaust ports, the diverter valve is movable between a flow blocking position at which the respective head end and rod end ports of the first fluid cylinder are blocked from the respective head end and rod end exhaust ports and a flow passing position at which the respective rod and head end ports of the first fluid cylinder are open to the respective head end and rod end exhaust ports, the diverter valve being biased to a flow blocking position in response to a mechanical biasing mechanism and the pressure in the rod end port of the first fluid cylinder and movable to a flow passing position in response to pressurized fluid in the head end port of the first fluid cylinder.

14. The fluid system of claim 13 including a relief valve disposed between the head end exhaust port of the diverter valve and the reservoir and a two-position blocker valve disposed between the rod end exhaust port and the reservoir, the two-position blocker valve being spring biased to a flow passing position and movable to a flow blocking position in response to pressurized pilot fluid being directed to the second directional control valve through the fourth pilot conduit.

15. The fluid system of claim 9 including a diverter valve operatively disposed between the rod end port of the first fluid cylinder and the second vented load check valve and operatively connected to the head end port of the first fluid cylinder, the diverter valve is biased to a position to permit fluid flow between the rod end port of the first fluid cylinder and the second vented load check valve and block fluid flow from the head end port to pass therethrough by a mechanical biasing mechanism and the pressure of the fluid in the rod end port of the first fluid cylinder, the diverter valve is movable to a second position at which the flow from the rod end port is diverted towards the reservoir and the flow from the head end port is permitted to pass therethrough towards the reservoir, the diverter valve is movable towards the second position in response to the pressurized fluid in the head end port of the first fluid cylinder.

16. The fluid system of claim 15 including a relief valve disposed between the head end flow from the diverter valve and the reservoir and a two-position blocker valve disposed between the rod end flow from the diverter valve and the reservoir, the two position blocker valve being biased to a flow passing position by a mechanical biasing mechanism and movable to a flow blocking position in response to pressurized pilot fluid being directed to the second directional control valve through the fourth pilot conduit.

* * * * *